US010245708B2

(12) United States Patent
Beveridge et al.

(10) Patent No.: US 10,245,708 B2
(45) Date of Patent: Apr. 2, 2019

(54) METHOD OF MAKING AN ABRASIVE ARTICLE AND ABRASIVE ARTICLE

(71) Applicant: 3M INNOVATIVE PROPERTIES COMPANY, St. Paul, MN (US)

(72) Inventors: Jacob S. Beveridge, Lake Elmo, MN (US); Steven J. Keipert, Houlton, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 9 days.

(21) Appl. No.: 15/502,942

(22) PCT Filed: Aug. 5, 2015

(86) PCT No.: PCT/US2015/043836

§ 371 (c)(1),
(2) Date: Feb. 9, 2017

(87) PCT Pub. No.: WO2016/032711

PCT Pub. Date: Mar. 3, 2016

(65) Prior Publication Data

US 2017/0225300 A1 Aug. 10, 2017

Related U.S. Application Data

(60) Provisional application No. 62/042,463, filed on Aug. 27, 2014.

(51) Int. Cl.
*B24D 3/02* (2006.01)
*B24D 3/20* (2006.01)
(Continued)

(52) U.S. Cl.
CPC ..... *B24D 18/0027* (2013.01); *B24D 3/02* (2013.01); *B24D 3/20* (2013.01); *B24D 3/32* (2013.01); *B24D 5/04* (2013.01)

(58) Field of Classification Search
CPC ..... B24D 18/0027; B24D 3/32; B24D 5/04
See application file for complete search history.

(56) References Cited

U.S. PATENT DOCUMENTS 2,083,719 A 6/1937 Kuzmick
2,453,704 A 11/1948 Dunlop
(Continued)

FOREIGN PATENT DOCUMENTS

CN 1091074 A 8/1994
CN 1138839 A 12/1996
(Continued)

OTHER PUBLICATIONS

Knop, Phenolic Resins; Springer-Verlag: New York, 1985, pp. 20-21.

(Continued)

*Primary Examiner* — Pegah Parvini
(74) *Attorney, Agent, or Firm* — Bradford B. Wright

(57) ABSTRACT

A method of making an abrasive article comprises urging a malleable thermosetting melt-flowable composition through openings extending through a porous abrasive member to form an abrasive article precursor; which is heated to form the abrasive article. Multiple abrasive articles may be stacked prior to heating. Methods can be used to fabricate abrasive articles such as grinding wheels and cut-off wheels.

11 Claims, 3 Drawing Sheets

(51) Int. Cl.

| | |
|---|---|
| ***B24D 3/32*** | (2006.01) |
| ***B24D 5/04*** | (2006.01) |
| ***B24D 18/00*** | (2006.01) |

(56) References Cited

U.S. PATENT DOCUMENTS

| | | | | | |
|---|---|---|---|---|---|
| 2,471,631 | A | | 5/1949 | Lebach | |
| 2,958,593 | A | | 11/1960 | Hoover | |
| 2,965,601 | A | | 12/1960 | Brown | |
| 3,041,156 | A | | 6/1962 | Rowse | |
| 3,406,020 | A | | 10/1968 | D'Alessandro | |
| 4,044,174 | A | * | 8/1977 | Carr | G11B 5/633 427/128 |
| 4,227,350 | A | | 10/1980 | Fitzer | |
| 4,253,850 | A | | 3/1981 | Rue | |
| 4,486,200 | A | * | 12/1984 | Heyer | B24D 3/002 451/532 |
| 4,609,380 | A | | 9/1986 | Barnett | |
| 4,682,988 | A | | 7/1987 | Narayanan | |
| 4,991,362 | A | | 2/1991 | Heyer | |
| 5,591,239 | A | | 1/1997 | Larson | |
| 5,674,122 | A | | 10/1997 | Krech | |
| 5,712,210 | A | | 1/1998 | Windisch | |
| 5,785,784 | A | * | 7/1998 | Chesley | A44B 18/0049 156/231 |
| 5,858,140 | A | | 1/1999 | Berger | |
| 6,017,831 | A | | 1/2000 | Beardsley | |
| 6,207,246 | B1 | | 3/2001 | Moren | |
| 6,302,930 | B1 | | 10/2001 | Lux | |
| 6,352,567 | B1 | * | 3/2002 | Windisch | B24D 3/004 51/294 |
| 6,432,482 | B1 | | 8/2002 | Jaffee | |
| 7,258,705 | B2 | | 8/2007 | Woo | |
| 8,142,531 | B2 | | 3/2012 | Adefris | |
| 8,142,532 | B2 | | 3/2012 | Erickson | |
| 8,142,891 | B2 | | 3/2012 | Culler | |
| 8,764,863 | B2 | | 7/2014 | Yener | |
| 9,321,149 | B2 | | 4/2016 | Van | |
| 2004/0170801 | A1 | | 9/2004 | Seth | |
| 2006/0148390 | A1 | * | 7/2006 | Woo | B24D 11/02 451/526 |
| 2008/0229672 | A1 | | 9/2008 | Woo | |
| 2009/0041983 | A1 | * | 2/2009 | Gaeta | B24D 3/20 428/141 |
| 2012/0227333 | A1 | | 9/2012 | Adefris | |
| 2012/0231691 | A1 | | 9/2012 | Peyras-Carratte | |
| 2013/0040537 | A1 | | 2/2013 | Schwabel | |
| 2013/0125477 | A1 | | 5/2013 | Adefris | |

FOREIGN PATENT DOCUMENTS

| | | | |
|---|---|---|---|
| CN | 1156424 | A | 8/1997 |
| GB | 1 495 576 | A | 12/1977 |
| WO | WO 0037561 | A1 | 6/2000 |
| WO | WO 2012-112305 | | 8/2012 |
| WO | WO 2012-141905 | A2 | 10/2012 |

OTHER PUBLICATIONS

Spange, "Composites from furfuryl alcohol and inorganic solids by cationic initiation, 2[a] Spectroscopic studies of poly(furfuryl alcohol)-silica composites obtained by trifluoroacetic acid initiation", Macromolecular Chemistry and Physics, 1993, vol. 194, pp. 1537-1544.

Zhang, "Chemistry of Novolac/Furfuryl Alcohol Resins Cured with Hexamethylenetetramine: A Solid-State NMR Study", Chemistry of Materials, 1998, vol. 10, No. 07, pp. 1833-1840.

International Search Report for PCT International Application No. PCT/US2015/043836, dated Nov. 18, 2015, 5 pages.

Extended European Search Report, EP15835237.7, dated Jul. 24, 2018, 3 pages.

* cited by examiner

METHOD OF MAKING AN ABRASIVE ARTICLE AND ABRASIVE ARTICLE

TECHNICAL FIELD

The present disclosure broadly relates to abrasive articles and methods of making them.

BACKGROUND

Bonded abrasive articles have abrasive particles retained in a binder (also known in the art as a bonding medium) that bonds them together as a shaped mass. Examples of typical bonded abrasives include grinding wheels, stones, hones, and cut-off wheels. The binder can be an organic resin, a ceramic or glassy material (both known in the art as examples of a vitreous binder), or a metal. Bonded abrasives such as, for example, grinding wheels and cut-off wheels often contain one or more scrim(s) as reinforcement.

Cut-off wheels are typically relatively thin wheels used for general cutting operations. The wheels are typically about 5 to about 200 centimeters in diameter, and several millimeters to several centimeters thick (with greater thickness for the larger diameter wheels). They may be operated at speeds from about 1000 to 50,000 revolutions per minute, and are used for operations such as cutting metal or glass, for example, to nominal lengths. Cut-off wheels are also known as "industrial cut-off saw blades" and, in some settings such as foundries, as "chop saws". As their name implies, cut-off wheels are use to cut stock such as, for example, metal rods, by abrading through the stock.

There is a continuing need for new bonded abrasives that have improved abrading properties and/or reduced cost at the same performance level.

SUMMARY

In one aspect, the present disclosure provides a method of making an abrasive article, the method comprising steps:

a) providing a porous abrasive member having first and second opposed major surfaces, wherein openings extending through the porous abrasive member from the first major surface to the second major surface, wherein the porous abrasive member comprises abrasive particles secured to a porous substrate by at least one binder material;

b) urging a malleable thermosetting melt-flowable composition through the openings in the porous abrasive member to form an abrasive article precursor; and c) heating the abrasive article precursor to form the abrasive article, wherein the abrasive article comprises first and second opposed major surfaces, and wherein both of the first and second major surfaces comprise a cross-linked reaction product of the malleable thermosetting melt-flowable composition.

In another aspect, the present disclosure provides a method of making an abrasive article, the method comprising steps:

i) providing a plurality of abrasive article precursors, wherein each abrasive article precursor is respectively prepared by a method comprising steps:

a) providing a porous abrasive member having first and second opposed major surfaces, wherein openings extending through the porous abrasive member from the first major surface to the second major surface, wherein the porous abrasive member comprises abrasive particles secured to a porous substrate by at least one binder material; and b) urging a malleable thermosetting melt-flowable composition through the openings in the porous abrasive member to form an abrasive article precursor; and ii) stacking the plurality of abrasive article precursors optionally with one or more reinforcing scrims disposed adjacent to each one of the abrasive article precursors to provide a abrasive article precursor stack; and iii)) heating the abrasive article precursor stack to form the bonded abrasive article, wherein the abrasive article comprises first and second opposed major surfaces, and wherein both of the first and second major surfaces comprise a cross-linked reaction product of the malleable thermosetting melt-flowable composition.

As used herein, the term "B-stage" indicates an intermediate stage in the curing of a thermosetting composition, wherein some cross-linking (i.e., covalent bond formation) has occurred, but the process is not yet complete, and the composition can be heated and caused to flow, and then finally cured in an intended shape.

As used herein, the term "melt-flowable" in reference to a composition means that the composition softens and flows (under gravity and/or otherwise applied pressure) when heated at a temperature above the ambient temperature. In the case of thermosetting compositions, the temperature above the ambient temperature is preferably below the curing temperature of the thermosetting composition. Melt-flowable thermosetting compositions include, for example, B-stage thermosetting compositions.

As used herein, the term "thermosetting composition" refers to a composition that may be cured by application of energy (e.g., thermal energy or electromagnetic radiation) through formation of covalent chemical bonds.

As used herein, the term "scrim" refers to a durable loosely woven fabric (e.g., made of glass fiber, polyester, or cotton) for use in industry.

Features and advantages of the present disclosure will be further understood upon consideration of the detailed description as well as the appended claims.

Figure 1:
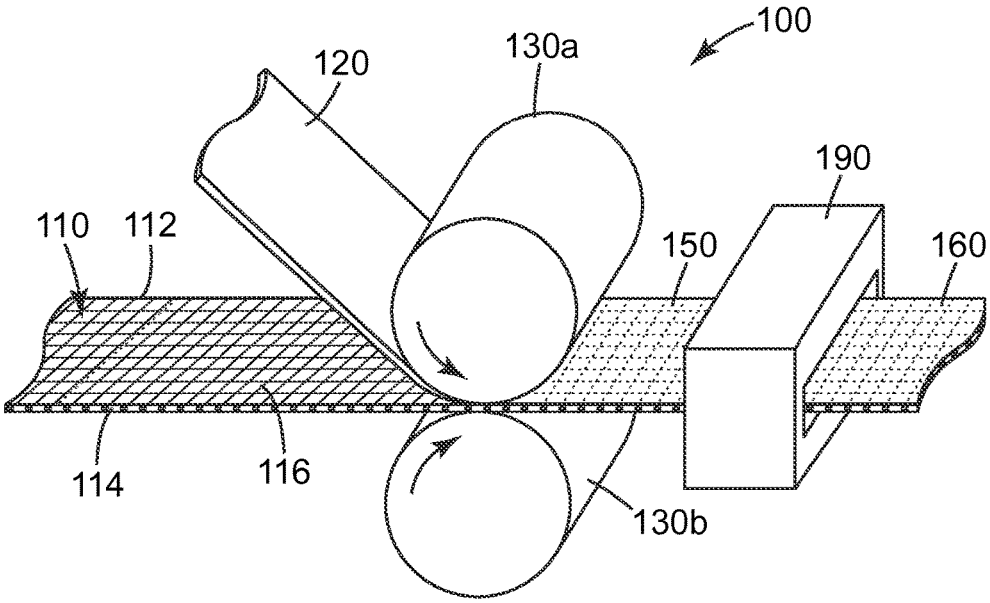
FIG. 1 is a schematic process flow diagram of an exemplary method 100 of making an abrasive article according to the present disclosure.
Figure 2:
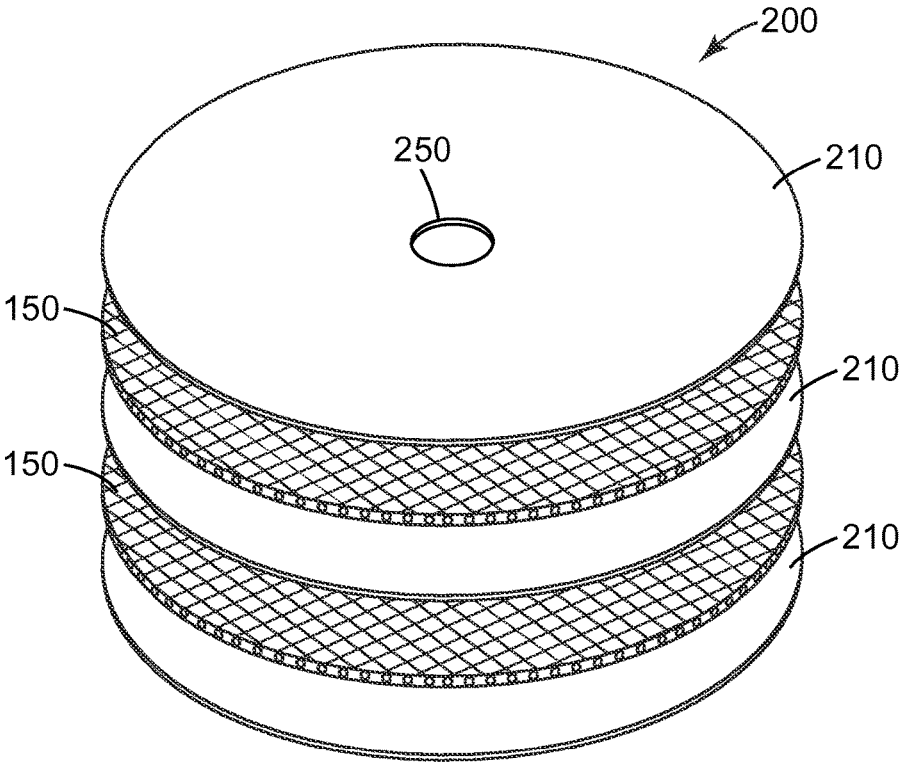
FIG. 2 is an exploded schematic perspective view an exemplary abrasive article precursor stack 200 useful in making an abrasive article according to the present disclosure.

Repeated use of reference characters in the specification and drawings is intended to represent the same or analogous features or elements of the disclosure. It should be understood that numerous other modifications and embodiments can be devised by those skilled in the art, which fall within the scope and spirit of the principles of the disclosure. The figures may not be drawn to scale.

DETAILED DESCRIPTION

FIG. 1 describes an exemplary method 100 of making an abrasive article 160 according to the present disclosure. Referring now to FIG. 1, in a first step a porous abrasive member 110 is provided. Porous abrasive member 110 has first and second opposed major surfaces 112, 114. Openings 116 extend through porous abrasive member 110 from first major surface 112 to second major surface 114. Malleable thermosetting melt-flowable composition 120 and porous abrasive member 110 are fed through nip rolls 130*a*, 130*b* which urge malleable thermosetting melt-flowable composition 120 through the openings in the abrasive members to form abrasive article precursor 150.

In one embodiment, abrasive article precursor 150 may be cured as formed directly out of the nip rolls (e.g., by optional oven 190), or it may be reinforced by placing one or more reinforcing scrims adjacent to the abrasive article precursor prior to curing to form abrasive article 160 (e.g., which may be converted into a cut-off wheel).

In another embodiment, a plurality of abrasive article precursors 150 may be arranged in a stack 200, optionally reinforced by placing one or more reinforcing scrims 210 adjacent to at least one of the abrasive article precursors 150 prior to curing to form abrasive article 270 (e.g., a grinding wheel) with central arbor hole 250.

Abrasive members such as sanding screens, abrasive scrims, and nonwoven abrasive articles can be used as the abrasive member. Screen abrasives generally have abrasive particles secured to an open mesh substrate such as, for example, a wire screen, glass fiber scrim, perforated metal foils and sheets, and perforated sheets of polymer or paper, or a polymer fiber (e.g., polyimide fiber) scrim.

The open mesh substrate can be made from any porous material, including, for example, perforated films or woven or knitted fabrics. The film for the backing can be made from metal, paper, or plastic, including molded thermoplastic materials and molded thermoset materials. In some embodiments, the open mesh substrate is made from perforated or slit and stretched sheet materials. In some embodiments, the open mesh backing is made from fiberglass, nylon, polyester, polypropylene, or aluminum. In those embodiments in which durability is important, the porous substrate comprises a wire screen or glass fiber scrim.

Figure 3:
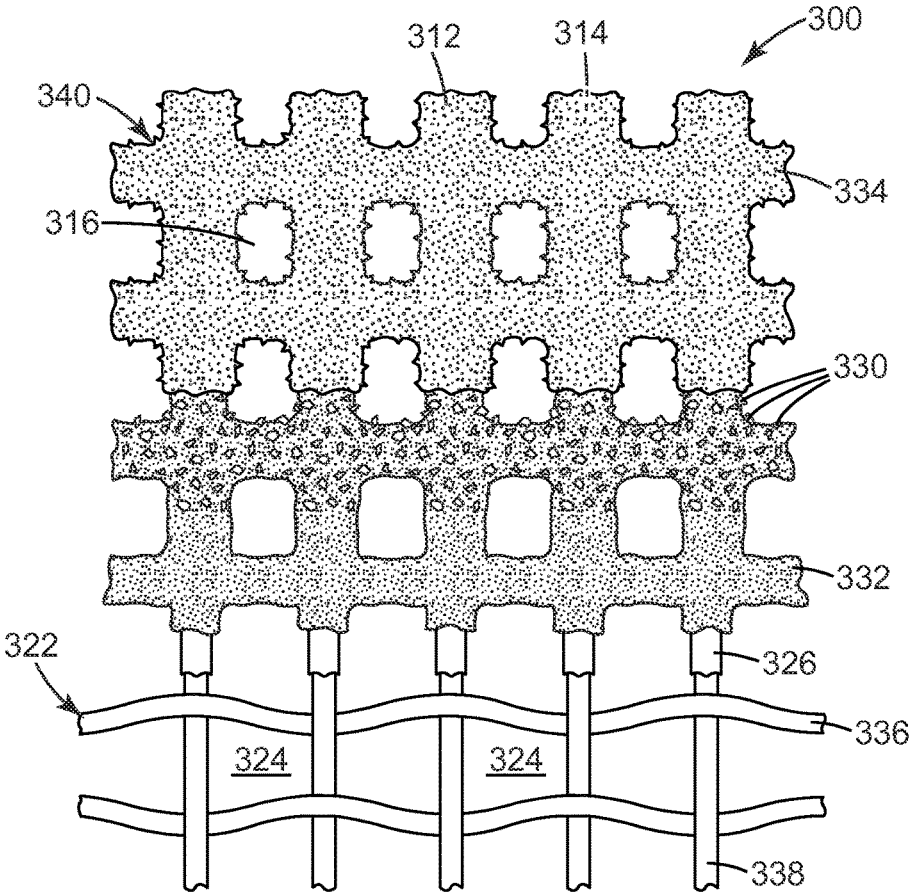
FIG. 3 is a schematic perspective view of an exemplary open mesh screen abrasive 300 partially cut away to reveal the components of the abrasive layer, and useful an abrasive member for making bonded abrasive articles according to methods of the present disclosure.

FIG. 3 shows an exemplary screen abrasive 300, suitable as a porous abrasive member, partially cut away to reveal the components of the abrasive layer. Referring to FIG. 3, screen abrasive 300 has first and second opposed major surfaces 312, 314. Openings 316 extending through screen abrasive 300 from first major surface 312 to second major surface 314. Screen abrasive 300 comprises abrasive particles 330 secured to porous open mesh substrate 322 by at least one binder material (i.e., make layer 332 and optional size layer 334).

Abrasive layer 340 comprises make layer 332, abrasive particles 330, and optional size layer 334. A plurality of openings 316 extend through the screen abrasive 300. The woven open mesh backing 322 comprises a plurality of generally parallel warp elements 338 that extend in a first direction and a plurality of generally parallel weft elements 336 that extend in a second direction. The weft elements 338 and warp elements 336 of the open mesh backing 322 form a plurality of openings 316. An optional lock layer 326 can be used to improve integrity of the open mesh backing or improve adhesion of the abrasive layer to the open mesh backing.

As shown in FIG. 3, openings 316 are approximately square-shaped. In some embodiments, the shape of the openings can be other geometric shapes, including, for example, a rectangle shape, a circle shape, an oval shape, a triangle shape, a parallelogram shape, a polygon shape, or a combination of these shapes. Openings 324 in open mesh backing 322 can be uniformly sized and positioned as shown in FIG. 3. In other embodiments, the openings can be placed non-uniformly by, by, for example, using a random opening placement pattern, varying the size or shape of the openings, or any combination of random placement, random shapes, and random sizes.

Typically, the make layer of a coated abrasive is prepared by coating at least a portion of the porous substrate (treated or untreated) with a make layer precursor. Abrasive particles are then at least partially embedded (e.g., by drop coating or electrostatic coating) to the make layer precursor comprising a first binder precursor, and the make layer precursor is subsequently at least partially cured. Electrostatic coating of the abrasive particles typically provides erectly oriented abrasive particles.

Next, the optional size layer is prepared by coating at least a portion of the make layer and abrasive particles with a size layer precursor comprising a second binder precursor (which may be the same as, or different from, the first binder precursor), and at least partially curing the size layer precursor.

A supersize layer may be applied to at least a portion of the size layer. If present, the supersize layer typically includes grinding aids and/or anti-loading materials. Typically, a binder is formed by curing (e.g., by thermal means, or by using electromagnetic or particulate radiation) a binder precursor. Useful first and second binder precursors are known in the abrasive art and include, for example, free-radically polymerizable monomer and/or oligomer, epoxy resins, acrylic resins, urethane resins, phenolic resins, urea-formaldehyde resins, melamine-formaldehyde resins, aminoplast resins, cyanate resins, or combinations thereof. Useful binder precursors include thermally curable resins and radiation curable resins, which may be cured, for example, thermally and/or by exposure to radiation.

Alternatively to make/size layer abrasive layers, the abrasive layer may be formed through a slurry coating process in which a slurry containing abrasive particles and binder precursor are coated on the open mesh substrate. In this embodiment, the abrasive particles and binder form a single layer on the porous backing.

Suitable abrasive particles for the screen abrasive that can be used in the abrasive article of the present invention can be any known abrasive particles or materials commonly used in abrasive articles. Examples of useful abrasive particles for coated abrasives include, for example, fused aluminum oxide, heat treated aluminum oxide, white fused aluminum oxide, black silicon carbide, green silicon carbide, titanium diboride, boron carbide, tungsten carbide, titanium carbide, diamond, cubic boron nitride, garnet, fused alumina zirconia, sol gel abrasive particles, silica, iron oxide, chromia, ceria, zirconia, titania, silicates, metal carbonates (such as calcium carbonate (e.g., chalk, calcite, marl, travertine, marble and limestone), calcium magnesium carbonate, sodium carbonate, magnesium carbonate), silica (e.g., quartz, glass beads, glass bubbles and glass fibers) silicates (e.g., talc, clays, (montmorillonite) feldspar, mica, calcium silicate, calcium metasilicate, sodium aluminosilicate, sodium silicate) metal sulfates (e.g., calcium sulfate, barium sulfate, sodium sulfate, aluminum sodium sulfate, aluminum sulfate), gypsum, aluminum trihydrate, graphite, metal oxides (e.g., tin oxide, calcium oxide), aluminum oxide, titanium dioxide) and metal sulfites (e.g., calcium sulfite), metal particles (e.g., tin, lead, copper), plastic abrasive particles formed from a thermoplastic material (e.g., polycarbonate, polyetherimide, polyester, polyethylene, polysulfone, polystyrene, acrylonitrile-butadiene-styrene block copolymer, polypropylene, acetal polymers, polyvinyl chloride, polyurethanes, nylon), plastic abrasive particles formed from crosslinked polymers (e.g., phenolic resins, aminoplast resins, urethane resins, epoxy resins, melamine-formaldehyde, acrylate resins, acrylated isocyanurate resins, urea-formaldehyde resins, isocyanurate resins, acrylated urethane resins, acrylated epoxy resins), and combinations thereof. The abrasive particles may also be agglomerates or composites that include additional components, such as, for example, a binder. Criteria used in selecting abrasive particles used for a particular abrading application typically include: abrading life, rate of cut, substrate surface finish, grinding efficiency, and product cost.

Useful abrasive particles also include shaped abrasive particles (e.g., precisely-shaped abrasive particles). Details concerning such abrasive particles and methods for their preparation can be found, for example, in U.S. Pat. No. 8,142,531 (Adefris et al.); U.S. Pat. No. 8,142,891 (Culler et al.); and U.S. Pat. No. 8,142,532 (Erickson et al.); and in U.S. Pat. Appl. Publ. No. 2012/0227333 (Adefris et al.); 2013/0040537 (Schwabel et al.); and 2013/0125477 (Adefris).

Coated screen abrasives can further comprise optional additives, such as, abrasive particle surface modification additives, coupling agents, plasticizers, fillers, expanding agents, fibers, antistatic agents, initiators, suspending agents, photosensitizers, lubricants, wetting agents, surfactants, pigments, dyes, UV stabilizers, and suspending agents. The amounts of these materials are selected to provide the properties desired. Additives may also be incorporated into the binder, applied as a separate coating, held within the pores of the agglomerate, or combinations of the above.

Screen abrasives are available from numerous commercial sources. Further details concerning screen abrasives can be found in, e.g., U.S. Pat. No. 7,258,705 (Woo et al.) and U.S. Pat. No. 5,674,122 (Krech).

Figure 4A:
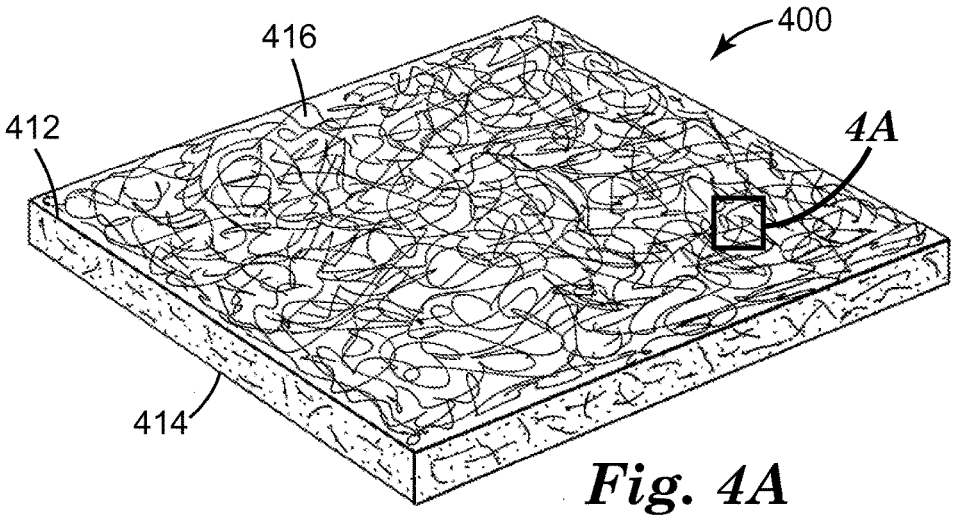
FIG. 4A is a perspective view of an exemplary nonwoven abrasive 400 useful as the abrasive member for making bonded abrasive articles according to methods of the present disclosure.
Figure 4B:
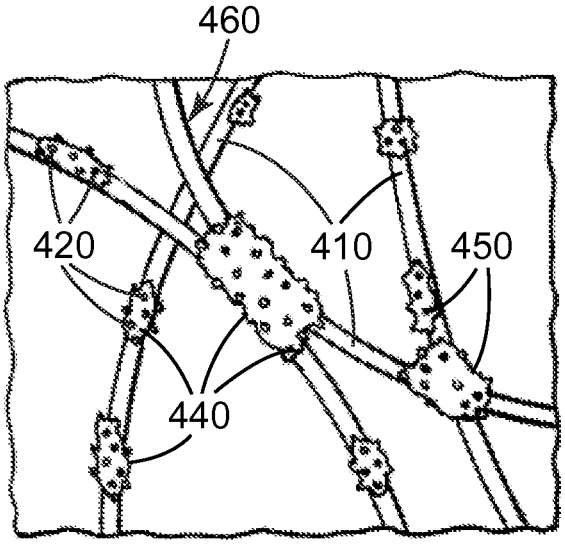
FIG. 4B is an enlarged view of region 4A in FIG. 4A.

Nonwoven abrasive articles typically include a porous (e.g., a lofty open porous) polymer filament structure having abrasive particles bonded thereto by a binder. An exemplary embodiment of a nonwoven abrasive article according to the present disclosure is shown in FIGS. 4A and 4B. Referring now to FIGS. 4A and 4B, nonwoven abrasive 400 has first and second opposed major surfaces 412, 414. Openings 416 extending through nonwoven abrasive 400 from first major surface 412 to second major surface 414. Nonwoven abrasive 400 comprises abrasive particles 420 secured to fibrous web 460 by at least one binder material 440. Lofty open low-density fibrous web 460 is formed of entangled filaments 410 impregnated with binder 440. Abrasive particles 420 are dispersed throughout the fibrous web 460 on exposed surfaces of filaments 410. Binder material 440 uniformly coats portions of filaments 410 and forms globules 450 which may encircle individual filaments or bundles of filaments, adhere to the surface of the filament and/or collect at the intersection of contacting filaments, providing abrasive sites throughout the nonwoven abrasive article. Binder precursors, binder materials, and abrasive particles described above in reference to screen abrasives may also be used in manufacture of nonwoven abrasive articles.

The fiber web may comprise continuous filaments (e.g., a spunbond fiber web) and/or staple fibers that may be crimped and/or entangled with one another. Exemplary fibers include polyester fibers, polyamide fibers, and polyaramid fibers. Selection of fiber length, diameter, and basis weight are generally selected depending on the intended use, and is within the capability of those of ordinary skill in the art.

Nonwoven abrasives are available from numerous commercial sources. Further description of techniques and materials for making nonwoven abrasive articles may be found in, for example, U.S. Pat. No. 2,958,593 (Hoover et al.); U.S. Pat. No. 4,227,350 (Fitzer); U.S. Pat. No. 4,609,380 (Barnett et al.); U.S. Pat. No. 4,991,362 (Heyer et al.); U.S. Pat. No. 5,712,210 (Windisch et al.); U.S. Pat. No. 5,591,239 (Edblom et al.); U.S. Pat. No. 5,858,140 (Berger et al.); U.S. Pat. No. 6,017,831 (Beardsley et al.); U.S. Pat. No. 6,207,246 (Moren et al.); and U.S. Pat. No. 6,302,930 (Lux).

Binder material precursors for organic binder materials, useful for making porous abrasive members as well as the malleable thermosetting melt-flowable composition, generally include one or more organic thermosetting compounds, typically containing one or more additive(s) such as, for example, fillers, curatives (e.g., catalysts, hardeners, free-radical initiators (photo- or thermal), grinding aids (e.g., cryolite), plasticizers, antiloading compounds, lubricants, coupling agents, antioxidants, light stabilizers, and/or antistatic agents. Examples of suitable organic thermosetting compounds include phenolic resins (e.g., novolac and/or resole phenolic resins), acrylic monomers (e.g., poly(meth) acrylates, (meth)acrylic acid, (meth)acrylamides), epoxy resins, cyanate resins, isocyanate resins (include polyurea and polyurethane resins), alkyd resins, urea-formaldehyde resins, aminoplast resins, and combinations thereof. During curing, these thermosetting compounds develop a covalently crosslinked bond network that hardens and strengthens the resulting organic binder material.

Useful phenolic resins include novolac and resole phenolic resins. Novolac phenolic resins are characterized by being acid-catalyzed and having a ratio of formaldehyde to phenol of less than one, typically between 0.5:1 and 0.8:1. Resole phenolic resins are characterized by being alkaline catalyzed and having a ratio of formaldehyde to phenol of greater than or equal to one, typically from 1:1 to 3:1. Novolac and resole phenolic resins may be chemically modified (e.g., by reaction with epoxy compounds), or they may be unmodified. Exemplary acidic catalysts suitable for curing phenolic resins include sulfuric, hydrochloric, phosphoric, oxalic, and p-toluenesulfonic acids. Alkaline catalysts suitable for curing phenolic resins include sodium hydroxide, barium hydroxide, potassium hydroxide, calcium hydroxide, organic amines, and/or sodium carbonate.

Examples of commercially available phenolic resins include those known by the trade designations "DUREZ" and "VARCUM" from Durez Corporation, Novi, Mich.; "RESINOX" from Monsanto Corp., Saint Louis, Mo.; "AROFENE" and "AROTAP" from Ashland Chemical Co., Columbus, Ohio; and "RUTAPHEN" by Momentive, Columbus, Ohio; and "PHENOLITE" by Kangnam Chemical Company Ltd. of Seoul, South Korea. Examples of commercially available novolac resins include those marketed as DUREZ 1364 and VARCUM 29302 from Durez Corporation. Examples of commercially available resole phenolic resins include VARCUM resoles in grades 29217, 29306, 29318, 29338, and 29353; AEROFENE 295; and PHENOLITE TD-2207.

Examples of useful aminoplasts include those available as CYMEL 373 and CYMEL 323 from Cytec Inc., Stamford, Conn.

Examples of useful urea-formaldehyde resins include that marketed as AL3029R from Borden Chemical, Columbus, Ohio, and those marketed as AMRES LOPR, AMRES PR247HV and AMRES PR335CU by Georgia Pacific Corp., Atlanta, Ga.

Examples of useful polyisocyanates include monomeric, oligomeric, and polymeric polyisocyanates (e.g., diisocyanates and triisocyanates), and mixtures and blocked versions thereof. Polyisocyanates may be aliphatic, aromatic, and/or a mixture thereof.

Examples of useful polyepoxides include monomeric polyepoxides, oligomeric polyepoxides, polymeric polyepoxides, and mixtures thereof. The polyepoxides may be aliphatic, aromatic, or a mixture thereof.

Examples of alicyclic polyepoxides monomers include epoxycyclohexane-carboxylates (e.g., 3,4-epoxycyclohexylmethyl 3,4-epoxycyclohexanecarboxylate (e.g., as available under the trade designation "ERL-4221" from Dow Chemical Co. (Midland, Mich.); 3,4-epoxy-2-methylcyclohexylmethyl 3,4-epoxy-2-methylcyclohexane-carboxylate, bis(3,4-epoxy-6-methylcyclohexylmethyl)adipate, 3,4-epoxy-6-methylcyclohexylmethyl 3,4-epoxy-6-methylcyclohexanecarboxylate (available as ERL-4201 from Dow Chemical Co.); vinylcyclohexene dioxide (available as ERL-4206 from Dow Chemical Co.); bis(2,3-epoxycyclopentyl)ether (available as ERL-0400 from Dow Chemical Co.), bis(3,4-epoxy-6-methylcyclohexylmethyl) adipate (available as ERL-4289 from Dow Chemical Co.), dipenteric dioxide (available as ERL-4269 from Dow Chemical Co.), 2-(3,4-epoxycyclohexyl-5,1'-spiro-3',4'-epoxycyclohexane-1,3-dioxane, and 2,2-bis(3,4-epoxycyclohexyl)propane, and polyepoxide resins derived from epichlorohydrin.

Examples of aromatic polyepoxides include polyglycidyl ethers of polyhydric phenols such as: Bisphenol A-type resins and their derivatives, including such epoxy resins having the trade designation "EPON" available from Resolution Performance Products, Houston, Tex.; epoxy cresol-novolac resins; Bisphenol-F resins and their derivatives; epoxy phenol-novolac resins; and glycidyl esters of aromatic carboxylic acids (e.g., phthalic acid diglycidyl ester, isophthalic acid diglycidyl ester, trimellitic acid triglycidyl ester, and pyromellitic acid tetraglycidyl ester), and mixtures thereof. Commercially available aromatic polyepoxides include, for example, those having the trade designation "ARALDITE" available from Ciba Specialty Chemicals, Tarrytown, N.Y.; aromatic polyepoxides having the trade designation "EPON" available from Resolution Performance Products; and aromatic polyepoxides having the trade designations "DER", "DEN", and "QUATREX" available from Dow Chemical Co.

Polyepoxide(s) are typically combined with a curing agent such as for example, a polyamine (e.g., a bis(imidazole)), polyamide (e.g., dicyandiamide), polythiol, or an acidic catalyst, although may not be required for curing.

Useful acrylic resins may include at least one (meth) acrylate (the term "(meth)acrylate" refers to acrylate and/or methacrylate) monomer or oligomer having an average acrylate functionality of at least two, for example, at least 3, 4, or even 5, and may be a blend of different (meth)acrylate monomers, (meth)acrylate oligomers, and/or (meth)acrylated polymers. A wide variety of (meth)acrylate monomers, (meth)acrylate oligomers, and (meth)acrylated polymers are readily commercially available, for example, from such vendors as Sartomer Company, Exton, Pa., and UCB Radcure, Smyrna, Ga. Exemplary acrylate monomers include ethylene glycol di(meth)acrylate, hexanediol di(meth)acrylate, triethylene glycol di(meth)acrylate, trimethylolpropane tri(meth)acrylate, glycerol tri(meth)acrylate, pentaerythritol tri(meth)acrylate, ethoxylated trimethylolpropane tri(meth) acrylate, neopentyl glycol di(meth)acrylate, pentaerythritol tetra(meth)acrylate, dipentaerythritol penta(meth)acrylate, sorbitol tri(meth)acrylate, sorbitol hexa(meth)acrylate, Bisphenol A di(meth)acrylate, ethoxylated Bisphenol A di(meth)acrylates, and mixtures thereof. Additional useful polyfunctional (meth)acrylate oligomers include polyether oligomers such as a polyethylene glycol 200 diacrylate marketed by Sartomer Company as SR 259; and polyethylene glycol 400 diacrylate marketed by Sartomer Company as SR 344.

Polymerizable acrylic monomers and oligomers such as those above, are typically cured with the aid of at least one free-radical thermal initiator (e.g., organic peroxides) or photoinitiator (e.g., thioxanthones, acylphosphines, acylphosphine oxides, benzoin ketals, alpha-hydroxy ketones, and alpha-dialkylamino ketones). Typical amounts range from 0.1 to 10 percent by weight, preferably 1 to 3 percent by weight, based on the weight of the organic binder material precursor.

Organic thermosetting compound(s) and optional thermoplastic polymer (if present) are typically used in an amount sufficient to result in a total organic binder material content of from about 5 to about 30 percent, more typically about 10 to about 25 percent, and more typically about 15 to about 24 percent by weight, based on the total weight of the resultant bonded abrasive article, although other amounts may also be used.

In a preferred embodiment, the malleable thermosetting binder material precursor composition comprises a novolac phenolic resin (in powder form) in combination with filler and at least one copolymerizable reactive solvent such as, for example, furfuryl alcohol, furfuryl aldehyde, poly(furfuryl aldehyde), or benzaldehyde. Preferred compositions comprise, on a total weight basis, from 3 to 25 percent of copolymerizable reactive solvent (more preferably 4 to 8 percent), from 25 to 60 percent of novolac phenolic resin containing an effective amount of a formaldehyde source such as, for example, hexamethylenetetramine (preferably included at a level of from 1 to 15 percent by weight based on the combined total weight of formaldehyde source and novolac resin), and from 40 to 70 percent 70 percent of grinding aids and/or/fillers. Novolac resins are typically solids at room temperature, but by addition of a copolymerizable reactive solvent and filler (and any additional components) they are preferably formulated to form a malleable and/or putty-like composition that is moldable, but will retain its shape unless heated and/or subjected to mechanical force (e.g., stretched or compressed). Examples of commercially available novolac phenolic resins include those available as: GP 2074, GP 5300, GP 5833, RESI-FLAKE GP-2049, RESI-FLAKE GP-2050, and RESI-FLAKE GP-2211 from Georgia Pacific Resins, Atlanta, Ga.; RUTAPHEN 8656F from Bakelite AG, Frielendorf, Germany; and DURITE 423 A and DURITE SD 1731 from Borden Chemical, Inc. Columbus, Ohio.

Examples of useful fillers include metal carbonates (e.g., calcium carbonate (e.g., chalk, calcite, marl, travertine, marble and limestone), calcium magnesium carbonate, sodium carbonate, magnesium carbonate), silica (e.g., quartz, glass beads, glass bubbles and glass fibers) silicates (e.g., talc, clays, (montmorillonite) feldspar, mica, calcium silicate, calcium metasilicate, sodium aluminosilicate, sodium silicate) metal sulfates (e.g., calcium sulfate, barium sulfate, sodium sulfate, aluminum sodium sulfate, aluminum sulfate), gypsum, vermiculite, wood flour, aluminum trihydrate, carbon black, metal oxides (e.g., calcium oxide (lime), aluminum oxide, titanium dioxide), and metal sulfites (e.g., calcium sulfite).

The malleable thermosetting melt-flowable composition is formulated such that it can be handled as a single material similar to a putty or paste; for example, not as loose granules or a liquid. In general, it is semi-solid. The composition may comprise any curable binder precursors and/or fillers described herein (e.g., in manufacture of make, size, or slurry layers). If desired, thermoplastic polymers (e.g., polyolefins, polyamides, polyesters, and/or polycarbonates) may be added to the composition to impart melt-flow characteristics. In some embodiments, the malleable thermosetting melt-flowable composition comprises novolac phenolic resin and furfuryl alcohol. In some embodiments, the malleable thermosetting melt-flowable composition consists essentially of novolac phenolic resin, furfuryl alcohol, and filler.

The malleable thermosetting melt-flowable composition can be prepared by mechanical mixing of the components in a mixer or kneader. The composition may be formed into a sheet or roll prior to contacting it with the abrasive member; however this is not a requirement. In any event, the composition and porous abrasive member must contact each other as they pass through a nip, or are otherwise urged together (e.g., in a press).

Advantageously, the malleable thermosetting melt-flowable composition can be readily manipulated by hand, making it more amenable to manual manufacturing processes such as, for example, abrasive wheel manufacture than liquid or powder resins by themselves.

The amount of the composition to be applied to the porous abrasive member will depend on the porosity and thickness of the porous abrasive member and the intended use of the resulting bonded abrasive article. In some preferred embodiments, 30 to 70 percent by weight of the uncured mass of the abrasive article precursor may be made up of the malleable thermosetting melt-flowable composition. Selection of appropriate amounts is within the capability of those of ordinary skill in the art.

Similarly the selection of the nip roll speed(s) and nip gap(s), or press pressures, can be readily determined by those of ordinary skill in the art. After urging the malleable thermosetting melt-flowable composition through the openings in the porous abrasive member, any excess composition can be trimmed from the abrasive article precursor (e.g., from its edges) and recycled through the process.

Whether individually, or stacked with others, the abrasive article precursor is heated to form the bonded abrasive article. During heating the malleable thermosetting melt-flowable composition softens and flows, then crosslinks (i.e., at least partially cures) becoming a strong binder material that maintains the shape of the abrasive article in use. Abrasive article precursors are typically heated at temperatures up to about 220° C. (although higher temperatures may also be used) for sufficient time to cure the malleable thermosetting melt-flowable composition and form a durable binder material.

Bonded abrasive articles according to the present disclosure are useful, for example, as hones, grinding wheels, and cut-off wheels.

Grinding wheels typically have a thickness of 0.5 cm to 100 cm, more typically 1 cm to 10 cm, and typically have a diameter between about 1 cm and 100 cm, more typically between about 10 cm and 100 cm, although other dimensions may also be used. For example, bonded abrasive articles may be in the form of a cup wheel generally between 10 and 15 cm in diameter, or may be in the form of a snagging wheel of up to 100 cm in diameter. An optional center hole may be used to attach the grinding wheel to a power-driven tool. If present, the center hole is typically 0.5 cm to 2.5 cm in diameter, although other sizes may be used. The optional center hole may be reinforced; for example, by a metal flange. Alternatively, a mechanical fastener may be axially secured to one surface of the cut-off wheel. Examples include threaded posts.

Cut-off wheels typically have a thickness of 0.80 millimeter (mm) to 16 mm, more typically 1 mm to 8 mm, and typically have a diameter between 2.5 cm and 100 cm (40 inches), more typically between about 7 cm and 13 cm, although diameters of up to several meters are known. An optional center hole (which may be depressed) may be used to attaching the cut-off wheel to a power driven tool. If present, the center hole is typically 0.5 cm to 2.5 cm in diameter, although other sizes may be used. The optional center hole may be reinforced; for example, by a metal flange. Alternatively, a mechanical fastener may be axially secured to one surface of the cut-off wheel. Examples include threaded posts, threaded nuts, Tinnerman nuts, and bayonet mount posts.

Select Embodiments of the Present Disclosure

In a first embodiment, the present disclosure provides a method of making an abrasive article, the method comprising steps:

a) providing a porous abrasive member having first and second opposed major surfaces, wherein openings extending through the porous abrasive member from the first major surface to the second major surface, wherein the porous abrasive member comprises abrasive particles secured to a porous substrate by at least one binder material;

b) urging a malleable thermosetting melt-flowable composition through the openings in the porous abrasive member to form an abrasive article precursor; and c) heating the abrasive article precursor to form the abrasive article, wherein the abrasive article comprises first and second opposed major surfaces, and wherein both of the first and second major surfaces comprise a cross-linked reaction product of the malleable thermosetting melt-flowable composition.

In a second embodiment, the present disclosure provides a method according to the first embodiment, wherein the malleable melt-flowable composition comprises novolac phenolic resin and furfuryl alcohol.

In a third embodiment, the present disclosure provides a method according to the first or second embodiment, wherein the at least one binder material comprises a make layer and a size layer.

In a fourth embodiment, the present disclosure provides a method according to any one of the first to third embodiments, wherein the substrate comprises a woven scrim.

In a fifth embodiment, the present disclosure provides a method according to any one of the first to third embodiments, wherein the substrate comprises a lofty open nonwoven fiber web.

In a sixth embodiment, the present disclosure provides a method according to any one of the first to fifth embodiments, wherein step b) comprises disposing the malleable thermosetting melt-flowable composition against the first major surface of the abrasive member and passing the malleable thermosetting melt-flowable composition and the abrasive member between a pair of nip rolls.

In a seventh embodiment, the present disclosure provides a method of making an abrasive article, the method comprising steps:

i) providing a plurality of abrasive article precursors, wherein each abrasive article precursor is respectively prepared by a method comprising steps:
   a) providing a porous abrasive member having first and second opposed major surfaces, wherein openings extending through the porous abrasive member from the first major surface to the second major surface, wherein the porous abrasive member comprises abrasive particles secured to a porous substrate by at least one binder material; and
   b) urging a malleable thermosetting melt-flowable composition through the openings in the porous abrasive member to form an abrasive article precursor; and
ii) stacking the plurality of abrasive article precursors optionally with one or more reinforcing scrims disposed adjacent to each one of the abrasive article precursors to provide a abrasive article precursor stack; and
iii)) heating the abrasive article precursor stack to form the bonded abrasive article, wherein the abrasive article comprises first and second opposed major surfaces, and wherein both of the first and second major surfaces comprise a cross-linked reaction product of the malleable thermosetting melt-flowable composition.

In an eighth embodiment, the present disclosure provides a method according to the seventh embodiment, wherein step iii) is carried out while the abrasive article precursor stack is under compression.

In a ninth embodiment, the present disclosure provides a method according to the seventh or eighth embodiment, wherein the malleable melt-flowable composition comprises novolac phenolic resin and furfuryl alcohol.

In a tenth embodiment, the present disclosure provides a method according to any one of the seventh to ninth embodiments, wherein the at least one binder material comprises a make layer and a size layer.

In an eleventh embodiment, the present disclosure provides a method according to any one of the seventh to tenth embodiments, wherein the substrate comprises a woven fiber scrim or wire mesh.

In a twelfth embodiment, the present disclosure provides a method according to any one of the seventh to tenth embodiments, wherein the substrate comprises a lofty open nonwoven fiber web.

In a thirteenth embodiment, the present disclosure provides a method according to any one of the seventh to twelfth embodiments, wherein step b) comprises disposing the malleable thermosetting melt-flowable composition against the first major surface of the abrasive member and passing the malleable thermosetting melt-flowable composition and the abrasive member between a pair of nip rolls.

Objects and advantages of this disclosure are further illustrated by the following non-limiting examples, but the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight.

Preparation of Shaped Abrasive Particles (SAP1)

Alpha alumina-based ceramic abrasive particles shaped as truncated triangular pyramids were prepared according to the disclosure of U.S. Pat. No. 8,142,531 (Adefris et al.) with nominal equal side lengths of 0.88 mm, a nominal thickness of 0.15 mm, and a sidewall angle of 98 degrees.

Preparation of Shaped Abrasive Particles (SAP2)

Alpha alumina-based ceramic abrasive particles shaped as truncated triangular pyramids were prepared according to the disclosure of U.S. Pat. No. 8,142,531 (Adefris et al.) with nominal equal side lengths of 1.49 mm, a nominal thickness of 0.33 mm, and a sidewall angle of 98 degrees Preparation of Malleable Thermosetting Melt-Flowable Composition (MTMFC1)

A malleable thermosetting melt-flowable composition was prepared by combining 200 g of BAKELITE 0224SP novolac from Momentive, Columbus, Ohio), 258 g of powdered potassium aluminum fluoride grinding aid (KBM Affilips B.V., The Netherlands), and 40 g of SIKA silicon carbide from Saint-Gobain, Courbevoie, France), were mixed together. To this mixture 40 g of furfuryl alcohol (from Alfa Aesar, 98%, Ward Hill, Mass.) was added. The resulting compound was pressed into 2 to 10 mm thick sheets at 150° F. (65.6° C.).

Preparation of Malleable Thermosetting Melt-Flowable Composition (MTMFC2)

A malleable thermosetting melt-flowable composition was prepared by combining 150 g of BAKELITE 0224SP novolac from Momentive, and 350 g of calcium aluminum silicate filler (available as ZEEOSPHERES N-400 from Zeeospheres Ceramics, Lockport, La.) were mixed together. To this mixture 25 g of furfuryl alcohol was added. The resulting compound was pressed into 2 to 10 mm thick sheets at 150° F. (65.6° C.).

Preparation of Make Coat Precursor (MCP1)

A make coat precursor was prepared by mixing 49 parts of resole phenolic resin (based-catalyzed condensate from 1.5:1 to 2.1:1 molar ratio of phenol:formaldehyde), 41 parts of calcium carbonate (HUBERCARB, Huber Engineered Materials, Quincy, Ill.) and 10 parts of water.

Preparation of Size Coat Precursor (SCP1)

A size coat precursor was prepared by mixing 29 parts of resole phenolic resin (base-catalyzed condensate from 1.5:1 to 2.1:1 molar ratio of phenol:formaldehyde), 51 parts of cryolite, 2 parts of red iron oxide, and 18 parts of water.

Cut Test Method

A 40-inch (102-cm) long sheet of 0.25 inch (6.4 mm) thick 304 stainless steel was secured with its major surface inclined at a 35-degree angle relative to horizontal. A guide rail was secured along the downward-sloping top surface of the inclined sheet. A DeWalt Model D28114 4.5-inch (11.4-cm)/5-inch (12.7-cm) cut-off wheel angle grinder was secured to the guide rail such that the tool was guided in a downward path under the force of gravity.

A cut-off wheel for evaluation was mounted on the tool such that the cut-off wheel encountered the full thickness of the stainless steel sheet when the cut-off wheel tool was released to traverse downward, along the rail under gravitational force. The cut-off wheel tool was activated to rotate the cut-off wheel at 10000 rpm, the tool was released to begin its descent, and the length of the resulting cut in the stainless steel sheet was measured after 60 seconds.

Grinding Test Method

Evaluation of grinding wheels was performed off hand using a 7-inch (18-cm) Ingersoll Rand pneumatic grinder operating at 6000 rotations per minute (90 pounds per square inch pressure (620 kPa). Type 304 stainless steel metal workpieces 18 inches (46 cm) long and ⅜ inch (0.95 cm) thick were abraded for one minute intervals. The weight of the workpiece was recorded before and after abrading to determine the mass loss. The grinding wheel was weight before and after 5 minutes of cutting. A G-ratio (unitless) was determined by dividing the average stock removal over 5 minutes of cutting by the wheel mass loss over 5 one minute cuts.

Comparative Example A

Comparative Example A was a 3M CUBITRON II TYPE I CUT-OFF WHEEL, 5-inch (12.5-cm) diameter, 0.06 inch (1.6 mm) thick, from 3M Company, Saint Paul, Minn.

Examples 1-6

MCP1 was brush-coated onto both sides of 5-inch (12.7-cm) diameter fiberglass scrims with 1 mm openings. A 0.11 g/in$^2$ (0.017 g/cm$^2$) MCP1 coat weight was used. Shaped alpha alumina-based ceramic abrasive particles as indicated in Table 1, were then drop coated onto both sides of the make coat precursor-coated scrim material. The coat weight of abrasive particles was 26 g. The resulting mineral-coated scrim was pre-cured in an oven at 90° C. for 3 hours, after which SCP1 was optionally applied by roll coating on both sides (as indicated) and pre-cured in an oven at 90° C. for 2 hours. The coat weight of SCP1 was 5 g. The coated scrims were then combined with MTMFC1 at 150° F. (65.6° C.) and 1050 pounds per square inch of pressure in a hydraulic press. The thickness of the abrasive article is determined by the grit size, amount, and number of mineral coated scrims stacked together to form the abrasive article. Excess MTMFC1 was trimmed from the edges of the abrasive wheel and the resultant abrasive disc precursor was cured in a batch oven over a 36 hour period with the temperature slowly ramping to a peak temperature of 190° C. The components of the abrasive disc were: 6 weight percent fiberglass reinforcement, 4 weight percent make coat precursor, 10 weight percent size coat precursor, 55 weight percent mineral, and 25 weight percent melt flowable compound.

The resultant abrasive cut-off wheels and Comparative Example A were tested according to the CUT TEST METHOD. Results are reported in Table 1 (below).

TABLE 1

| | | | CUT TEST METHOD RESULTS | | | |
|---|---|---|---|---|---|---|
| EXAMPLE | DISC DESCRIPTION | | PERFORMANCE, inches/cm$^3$ (cm/cm$^3$) | CUT RATE, inches/minute (cm/min) | TOTAL CUT LENGTH, inches (cm) | RATE, WEAR cm$^3$/min |
| 1 | 2 g MCP1, 5 g SCP1, SAP1, 0.074 inch (1.88 mm) thick | 1st Cut | 30.0 (76.2) | 30.5 (77.5) | 30.5 (77.5) | 1.02 |
| | | 2nd Cut | 20.5 (52.1) | 36.0 (91.4) | 36.0 (91.4) | 1.76 |
| | | 3rd Cut | 19.2 (48.8) | 37.0 (94.0) | 37.0 (94.0) | 1.92 |
| 2 | 2 g MCP1, 5 g SCP1, SAP2, 0.06 inch (1.5 mm) thick | 1st Cut | 24.0 (61.0) | 41.4 (105) | 40.0 (102) | 1.73 |
| 3 | 2 g MCP1, 5 g SCP1 SAP2, 0.116 inch (2.95 mm) thick | 1st Cut | 20.9 (53.1) | 22.5 (57.2) | 22.5 (57.7) | 1.08 |
| 4 | 2 g MCP1, no SCP1 SAP2, 0.116 inch (2.95 mm) thick | 1st Cut | 20.3 (51.6) | 24.8 (63.0) | 24.8 (63.0) | 1.22 |
| COMPARATIVE EXAMPLE A | 36+ grit size | 1st Cut | 26.0 (66.0) | 36.7 (93.2) | 36.7 (93.2) | 1.73 |

Comparative Example B

Comparative Example B was a 3M CUBITRON II TYPE 27 DEPRESSED CENTER GRINDING WHEEL, 7-inch (17.8 -cm) diameter, 0.25 inch (6.35 mm) thick, from 3M Company, Saint Paul, Minn.

Example 7

MCP1 was brush-coated onto both sides of a 7-inch (17.8-cm) diameter fiberglass scrims with 1 mm openings. A 0.11 g/in$^2$ (0.017 g/cm$^2$) of MCP1 coat weight was used. Alpha alumina-based ceramic abrasive particles shaped as truncated triangular pyramids and prepared according to the disclosure of U.S. Pat. No. 8,142,531 (Adefris et al.) with nominal equal side lengths of 1.49 mm, a nominal thickness of 0.33 mm, and a sidewall angle of 98 were then drop coated onto both sides of the make coat precursor-coated scrim material. The coat weight of mineral was 52 g. The resulting mineral-coated scrim was pre-cured in an oven at 90° C. for 3 hours, after which 10 g of SCP1 was applied by roll coating on both sides and pre-cured in an oven at 90° C. for 2 hours. Two mineral coated scrims prepared as above were stacked on top of each other. The coated scrims were then combined with MTMFC1 at 150° F. (65.6° C.) and 1050 pounds per square inch of pressure in a hydraulic press.

The thickness of the abrasive article is determined by the grit size, amount, and number of mineral coated scrims stacked together to form the abrasive article. Excess MTMFC1 was trimmed from the edges of the abrasive wheel and the resultant abrasive disc precursor was cured in a batch oven over a 36 hour period with the temperature slowly ramping to a peak temperature of 190° C. The components of the abrasive disc were: 6 weight percent fiberglass reinforcement, 4 weight percent make coat precursor, 10 weight percent size coat precursor, 55 weight percent mineral, and 25 weight percent melt flowable compound.

The resultant abrasive grinding wheel and Comparative Example B were tested according to the GRINDING TEST METHOD. Results are reported in Table 2 (below).

TABLE 2

| | CUT 1, grams | CUT 2, grams | CUT 3, grams | CUT 4, grams | CUT 5, grams | WHEEL WEAR, percent by weight | G RATIO |
|---|---|---|---|---|---|---|---|
| EXAMPLE 7 | 34.8 | 37.9 | 38.6 | 39.7 | 41.2 | 1.05 | 12 |
| COMPARATIVE EXAMPLE B | 56 | 54.9 | 51.4 | 50.2 | 51.4 | 2.36 | 28 |

All cited references, patents, and patent applications in the above application for letters patent are herein incorporated by reference in their entirety in a consistent manner. In the event of inconsistencies or contradictions between portions of the incorporated references and this application, the information in the preceding description shall control. The preceding description, given in order to enable one of ordinary skill in the art to practice the claimed disclosure, is not to be construed as limiting the scope of the disclosure, which is defined by the claims and all equivalents thereto.

What is claimed is:

1. A method of making an abrasive article, the method comprising steps:

a) providing a porous abrasive member having first and second opposed major surfaces, wherein openings extending through the porous abrasive member from the first major surface to the second major surface, wherein the porous abrasive member comprises abrasive particles secured to a porous substrate by at least one binder material;

b) urging a malleable thermosetting melt-flowable composition through the openings in the porous abrasive member to form an abrasive article precursor, wherein the malleable melt-flowable composition comprises novolac phenolic resin and furfuryl alcohol; and c) heating the abrasive article precursor to form the abrasive article, wherein the abrasive article comprises first and second opposed major surfaces, and wherein both of the first and second major surfaces comprise a cross-linked reaction product of the malleable thermosetting melt-flowable composition.

2. The method of claim 1, wherein the at least one binder material comprises a make layer and a size layer.

3. The method of claim 1, wherein the substrate comprises a woven scrim.

4. The method of claim 1, wherein the substrate comprises a lofty open nonwoven fiber web.

5. The method of claim 1, wherein step b) comprises disposing the malleable thermosetting melt-flowable composition against the first major surface of the abrasive member and passing the malleable thermosetting melt-flowable composition and the abrasive member between a pair of nip rolls.

6. A method of making an abrasive article, the method comprising steps:

i) providing a plurality of abrasive article precursors, wherein each abrasive article precursor is respectively prepared by a method comprising steps:

a) providing a porous abrasive member having first and second opposed major surfaces, wherein openings extending through the porous abrasive member from the first major surface to the second major surface, wherein the porous abrasive member comprises abrasive particles secured to a porous substrate by at least one binder material; and b) urging a malleable thermosetting melt-flowable composition through the openings in the porous abrasive member to form an abrasive article precursor, wherein the malleable melt-flowable composition comprises novolac phenolic resin and furfuryl alcohol; and ii) stacking the plurality of abrasive article precursors optionally with one or more reinforcing scrims disposed adjacent to each one of the abrasive article precursors to provide a abrasive article precursor stack; and iii)) heating the abrasive article precursor stack to form the abrasive article, wherein the abrasive article comprises first and second opposed major surfaces, and wherein both of the first and second major surfaces comprise a cross-linked reaction product of the malleable thermosetting melt-flowable composition.

7. The method of claim 6, wherein step iii) is carried out while the abrasive article precursor stack is under compression.

8. The method of claim 6, wherein the at least one binder material comprises a make layer and a size layer.

9. The method of claim 6, wherein the substrate comprises a woven fiber scrim or wire mesh.

10. The method of claim 6, wherein the substrate comprises a lofty open nonwoven fiber web.

11. The method of claim 6, wherein step b) comprises disposing the malleable thermosetting melt-flowable composition against the first major surface of the abrasive member and passing the malleable thermosetting melt-flowable composition and the abrasive member between a pair of nip rolls.

* * * * *